US005335759A

United States Patent [19]

Yeh

[11] Patent Number: 5,335,759

[45] Date of Patent: Aug. 9, 1994

[54] EXTENDIBLE HANDLE ASSEMBLY FOR WHEELED LUGGAGE

[76] Inventor: Tsang-Chieh Yeh, No. 13-1 Alley 2 Lane 129 Chukwang Road, Chungho City Taipei Hsien, Taiwan

[21] Appl. No.: 73,082

[22] Filed: Jun. 8, 1993

[51] Int. Cl.[5] ..... A45C 9/00; A45C 13/22; A45C 13/26

[52] U.S. Cl. ..... 190/115; 190/18 A; 190/39; 280/37

[58] Field of Search ..... 190/18 A, 115, 39; 280/37, 47, 3.15, 47.371, 655.1

[56] References Cited

U.S. PATENT DOCUMENTS

| | | | |
|---|---|---|---|
| 1,958,587 | 5/1934 | Mitchell et al. | 190/115 X |
| 2,607,396 | 8/1952 | Stambaugh, Jr. | 280/655.1 X |
| 2,925,283 | 2/1960 | Stilger | 280/37 |
| 3,946,839 | 3/1976 | Butler | 190/18 A |
| 4,036,336 | 7/1977 | Burtley | 190/18 A |
| 4,087,102 | 5/1978 | Sprague | 190/18 A X |
| 4,256,320 | 3/1981 | Hager | 190/18 A X |
| 4,266,791 | 5/1981 | Myers | 280/37 |
| 4,314,624 | 2/1982 | Royet | 190/18 A |
| 4,836,565 | 6/1989 | Catalo | 280/37 |
| 4,995,487 | 2/1991 | Plath | 190/18 A |
| 5,108,119 | 4/1992 | Huang | 280/37 |
| 5,167,306 | 12/1992 | Carrigan, Jr. | 190/115 X |

FOREIGN PATENT DOCUMENTS

| | | | |
|---|---|---|---|
| 226769 | 9/1985 | Fed. Rep. of Germany | 190/115 |
| 111470 | 10/1918 | United Kingdom | 190/115 |
| 209888 | 1/1924 | United Kingdom | 280/47.371 |
| 914533 | 1/1963 | United Kingdom | 280/655.1 |

*Primary Examiner*—Sue A. Weaver
*Attorney, Agent, or Firm*—Bacon & Thomas

[57] ABSTRACT

A collapsible frame structure for a luggage assembly comprises two elongated bar members telescopically and movably received within two elongated tubular members at the lower ends thereof through skew holes provided on the receiving ends of the tubular members so as to make the bar members skew with respect to the tubular member and thus a frictional sleeve attached to the lower end of each of the bar members is in a frictional engagement with the inside surface of the respective tubular member. With such a frictional engagement, the bar members are allowed to move relative to the tubular members when forcibly pushed or pulled while capable of being maintained at any desirable position along the length of the tubular members.

5 Claims, 4 Drawing Sheets

EXTENDIBLE HANDLE ASSEMBLY FOR WHEELED LUGGAGE

FIELD OF THE INVENTION

The present invention relates generally to a luggage assembly having a suitcase mounted to a collapsible support frame and in particular to such a collapsible support frame with a friction type retaining device.

BACKGROUND OF THE INVENTION

Luggage assemblies having suitcases mounted on a collapsible support frame are very popular for the collapsibility of the support frame. This provides a saving in storage space and a convenience in use. The collapsible support frame has a retaining device to retain the support frame in the expanded condition thereof. One of the conventional retaining devices for the support frame comprises spring-biased retaining pins which are engageable with pin holes formed on the support frame to releasably retain the support frame in the expanded condition. To release the frame from the expanded condition, a push on the retaining pins against the biasing spring by the fingers of a user is applied on the pins to break the engagement between the pins and the pin holes.

The deficiency is that the user may need to bow or squat to access the retaining pins in order to release the support frame. This obviously causes an inconvenience in using the luggage assembly.

It is therefore desirable to provide a retaining device for the collapsible support frame of a luggage assembly to overcome the deficiency of the known devices.

SUMMARY OF THE INVENTION

It is therefore the principal object to provide a collapsible support frame for a luggage assembly which comprises a friction type retaining device so that the support frame is retained in the expanded condition by frictional forces and thus the support frame can be released from the expanded condition by forcibly pushing same.

It is also an object of the present invention to provide a collapsible support frame for a luggage assembly which is simple in structure and thus less costly in manufacturing.

To achieve the above objects, there is provided a collapsible support frame for a luggage assembly comprising two elongated bar members telescopically and movably received within two elongated tubular members at the lower ends thereof through skew holes provided on the receiving ends of the tubular members so as to make the bar members skew with respect to the tubular member and thus a frictional sleeve attached to the lower end of each of the bar members is in a frictional engagement with the inside surface of the respective tubular member. With such a frictional engagement, the bar members are allowed to move relative to the tubular members when forcibly pushed or pulled while capable of being maintained at any desirable position along the length of the tubular members.

BRIEF DESCRIPTION OF THE DRAWINGS

The instant invention will be apparent from the following description of a preferred embodiment of the invention illustrated in the attached drawings, wherein.

DETAILED DESCRIPTION OF THE PREFERRED EMBODIMENT

Figure 1:
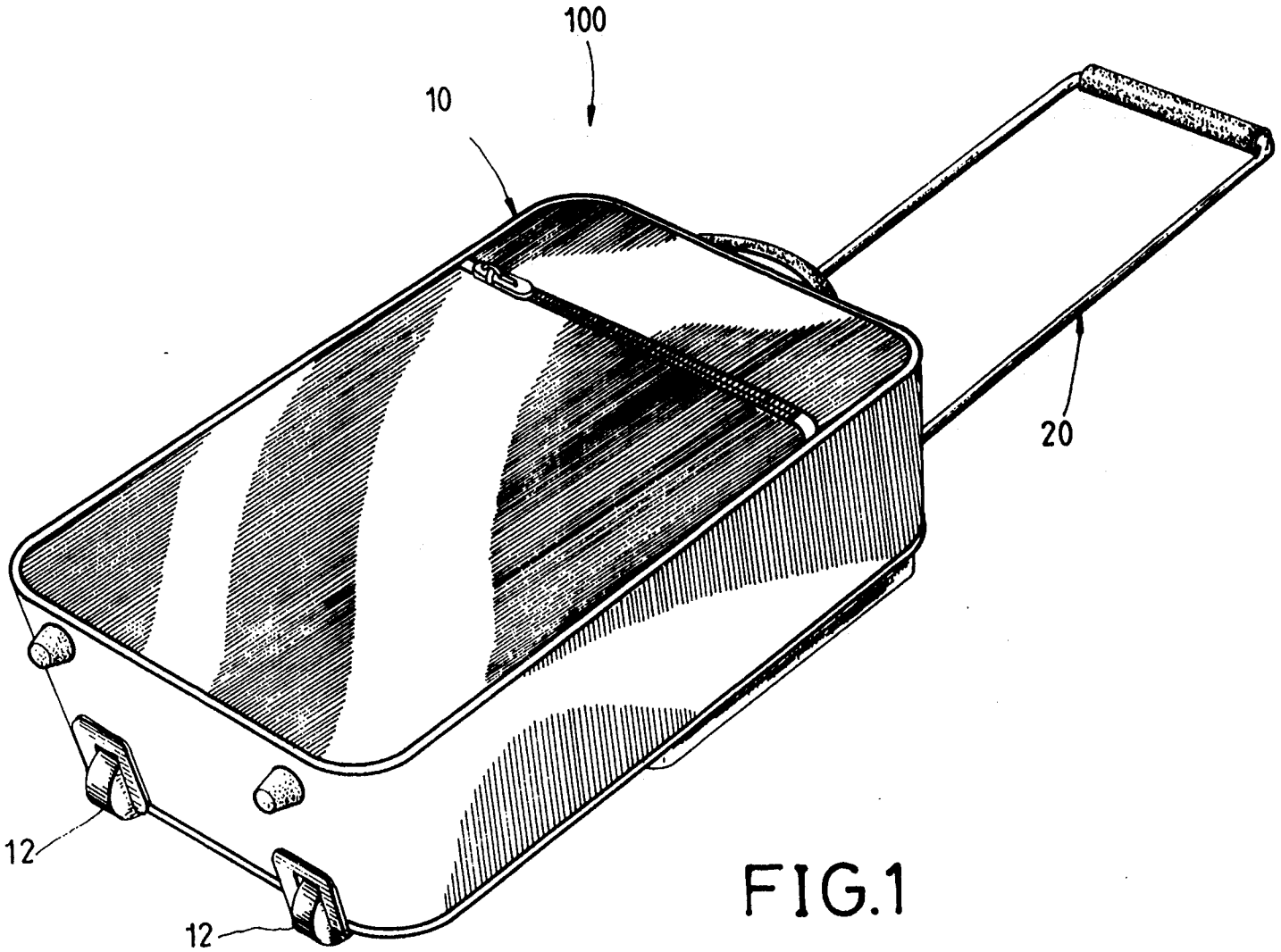
FIG. 1 is a perspective view showing a luggage assembly in which a collapsible support frame constructed in accordance with the present invention is adopted.
Figure 2:
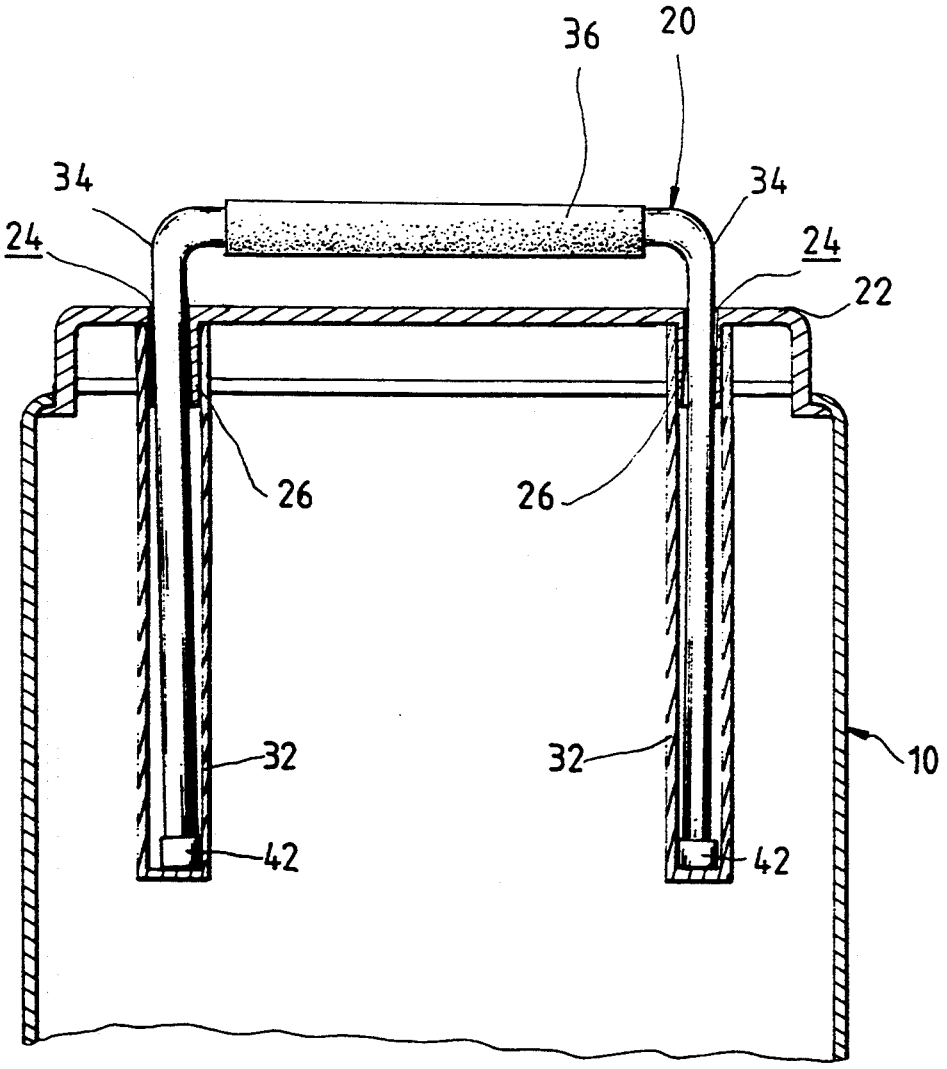
FIGS. 2 and 3 are partial cross-sectional views respectively showing a collapsed condition and an expanded condition of the collapsible support frame in accordance with the present invention.

With reference to the drawings and in particular to FIG. 1, wherein a luggage assembly, generally designated with the reference numeral 100, is shown, the luggage assembly 100 generally comprises a suitcase 10 mounted on a collapsible support frame 20. Casters or wheels 12 are provided on a lower side of the suitcase 10 to effect transport of the suitcase 10. The support frame 20 is mounted to the suitcase 10 at an upper side of the suitcase 10, opposite to the lower side thereof, to be collapsible between a collapsed, lowered compact position, as shown in FIG. 2, and a raised expanded position shown in FIG. 3. Retaining means is provided to retain the support frame 20 in the raised expanded position.

Such a luggage assembly 100 is available in the market. As discussed previously, one of the disadvantages thereof is the use of pin-based retaining means. The conventional pin-based retaining means comprises retaining pins biased by springs to engage pin holes formed on the support frame or the suitcase body so as to maintain the support frame in the raised expanded position. This causes an inconvenience. For simplicity, the structure of the conventional retaining means is not illustrated in the drawings.

According to an aspect of the present invention, a friction type retaining device for the collapsible support frame 20 of the luggage assembly 100 is disclosed. With reference to FIGS. 2–5, the suitcase 10 comprises a mount plate 22 which is secured on the suitcase 10. Two longitudinal holes 24 are formed on the mount plate 22 in a substantially symmetrical manner. Each of the holes 24 extends longitudinally through a hollow cylinder 26 (see FIG. 5) so that the central axis 28 of the hole 24 is skewed with respect to the central axis 30 of the overall cylinder 26. An elongated tubular member 32 has an open end concentrically engaged over the outside diameter of each of the cylinders 26 to provide a noncoaxial extension of the hole 24. Preferably, each of the tubular members 32 has an opposite closed end.

The support frame 20 comprises two elongated bar members 34, made of an elastically deformable material, respectively telescopically and movably received within each of the skew holes 24 and its associated tubular member 32. The bar members 34 are connected by a handle bar 36 at the upper ends thereof to provide a handhold for the user. Each of the bar members 34 has at the lower end thereof a retaining device 40 (see FIG. 4) mounted thereon.

The retaining device 40 comprises a cylindrical, frictional sleeve 42, preferably made of a high friction material, such as rubber or plastic, engaged over the lower end of the bar member 34 and secured thereon by a pin member 4 which extends through both the sleeve 42 and the bar member 34, for example via a hole 46 of the sleeve 42 and a hole 48 formed on the lower end of the bar member 34.

The skewness provided by the skew holes 24 allows the bar members 34 to be received within the tubular members 32 in a convergent manner at the lower ends thereof so as to elastically bend the bar members 34 to dispose the frictional sleeves 42 in a forcibly contacting engagement with the inner surfaces of the tubular members 32 and form a frictional relationship therebetween so as to retain the bar members 34 with respect to the tubular members 32 in any desirable position along the length of the tubular members 32, especially in the proximity of the upper ends of the tubular members 32, by the friction therebetween.

The frictional force between the sleeves 42 and the inside surfaces of the tubular members 32 is carefully selected to be strong enough to retain the sleeves 42 and thus the bar members 34 at any location along the tubular members 32 while allowing a user to forcibly move the bar members 34 relative to the tubular members 32.

Each of the cylinders 26 provides a shoulder 50 within the respective tubular member 32 for serving as a stop for the movement of the sleeves 42 along a first direction toward the expanded position within the tubular members 32.

Figure 3:
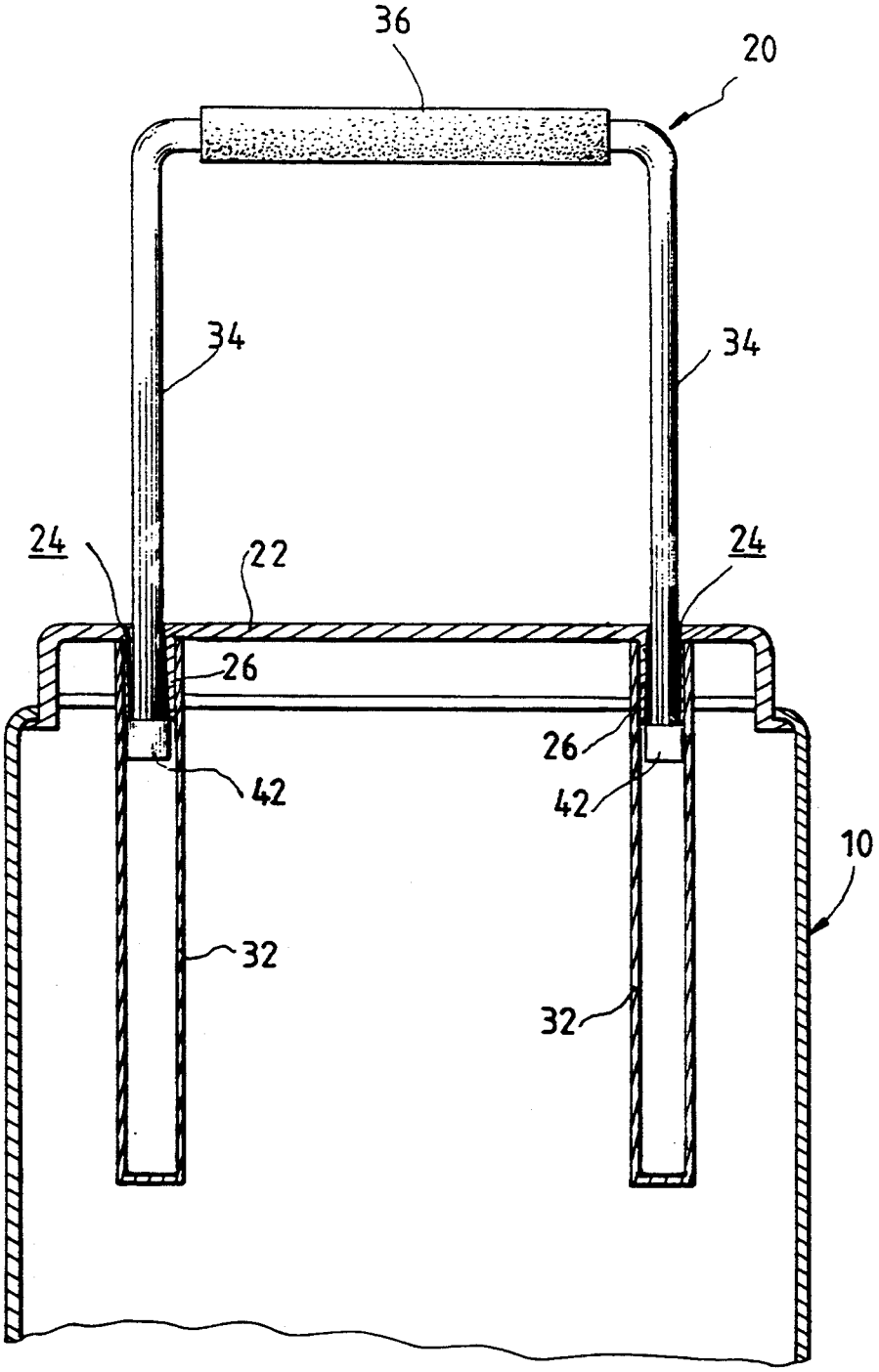
Figure 4:
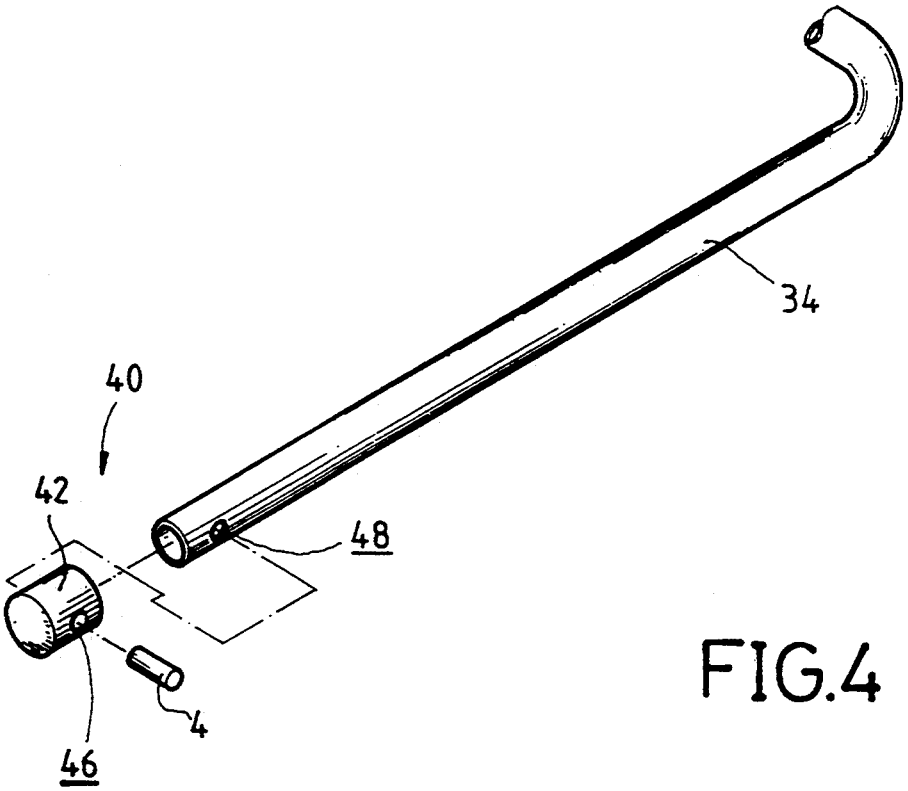
FIG. 4 is an exploded .perspective view showing a bar member comprised of the collapsible support frame of the present invention.
Figure 5:
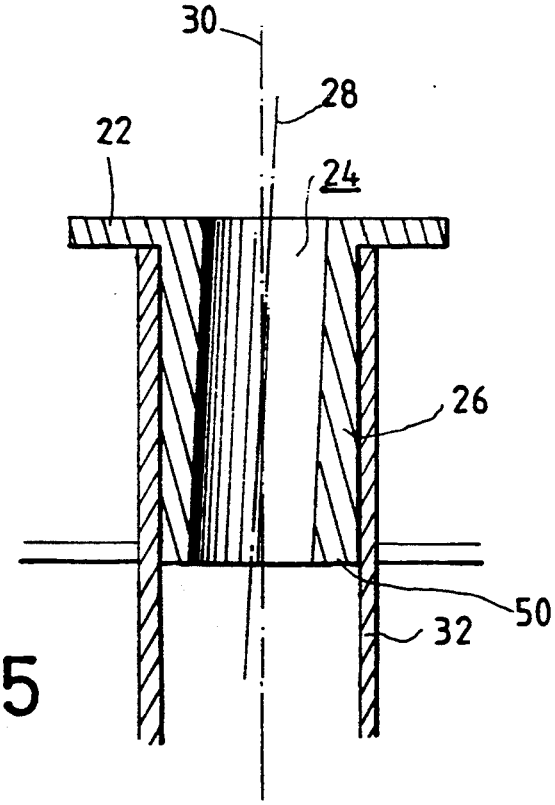
FIG. 5 is a partial cross-sectional view showing the skew hole for receiving the bar member therein.

With the above structure, the bar members 34 is movable within the raised, expanded position where the sleeves 42 abut against the shoulders 50 provided by the cylinders 26, as shown in FIG. 3, and a lowered, compact position where the bar members 34 are telescoped into the tubular members 32 via the holes 24, as shown in FIG. 2. The closed ends of the tubular members 32 may serve as stops for the telescoping into the tubular members 32 of the bar members 34 along a second direction opposite to the first direction.

It is apparent that although the invention has been described in connection with the preferred embodiment, it is contemplated that those skilled in the art may make changes to certain features of the preferred embodiment without altering the basic concept of the invention as defined in the appended claims.

What is claimed is:

1. An extendible handle assembly for wheeled luggage comprising:

a) a pair of cylindrical members for mounting to the luggage, each cylindrical member having a first central axis and a longitudinal hole extending therethrough, the longitudinal hole having a second central axis that is skewed with respect to the first central axis;

b) a tubular member having a first and concentrically engaged on each cylindrical member and forming a noncoaxial extension of the longitudinal hole;

c) a pair of elastically deformable elongate bar members, each bar member including an upper end and a lower end, a handle means joining the upper ends and each lower end being provided with a friction sleeve thereon;

d) each bar member being slidably received through a longitudinal hole to dispose the lower end within a tubular member and permit the bar members to be disposed between fully extended and fully retracted positions by respectively pulling and pushing the handle means; and e) wherein each longitudinal hole deforms each elongate bar member in alignment with the second central axis, thereby urging each friction sleeve into frictional engagement against an internal wall of the tubular member to permit the bar members to be maintained at any desired position between the fully extended and fully retracted positions.

2. The support frame assembly of claim 1 wherein each cylindrical member includes a shoulder at a lower end thereof and each tubular member includes a closed lower end for engagement by the lower end of the bar member and terminate its sliding movement in the respective fully extended and fully retracted positions.

3. The support frame assembly of claim 1 wherein each friction sleeve is formed of a high friction material.

4. The support frame assembly of claim 3 wherein the high friction material includes rubber.

5. The support frame assembly of claim 3 wherein the high friction material includes plastic.

* * * * *